US005259218A

United States Patent [19]

Broadbent

[11] Patent Number: 5,259,218

[45] Date of Patent: Nov. 9, 1993

[54] FORCE MINIMIZING SUSPENSION SYSTEM FOR ROTARY WASHER/EXTRACTORS

[75] Inventor: John Broadbent, Bloomingdale, Ill.

[73] Assignee: Ellis Corporation, Itasca, Ill.

[21] Appl. No.: 997,602

[22] Filed: Dec. 28, 1992

Related U.S. Application Data

[62] Division of Ser. No. 762,379, Sep. 19, 1991, Pat. No. 5,218,731.

[51] Int. Cl.[5] ..... D06F 37/22

[52] U.S. Cl. ..... 68/12.06; 68/23.1; 68/19.2

[58] Field of Search ..... 68/210, 12.06, 25, 12.02, 68/19.2, 23.1, 26; 474/82; 248/636; 210/144

[56] References Cited

U.S. PATENT DOCUMENTS

| | | | |
|---|---|---|---|
| 4,096,988 | 6/1978 | Scuricini | 494/82 |
| 4,537,382 | 8/1985 | Beck | 494/82 |
| 4,835,993 | 6/1987 | Dreher | 68/210 |
| 5,085,064 | 2/1992 | Hayashi et al. | 68/12.06 |
| 5,105,260 | 11/1992 | Geiger | 18/12.06 |

FOREIGN PATENT DOCUMENTS

| | | | |
|---|---|---|---|
| 54-147663 | 11/1979 | Japan | 68/12.06 |

*Primary Examiner*—Frankie L. Stinson

*Attorney, Agent, or Firm*—Mason, Kolehmainen, Rathbury & Wyss

[57] ABSTRACT

A rotary washer/extractor for use with textiles and other materials includes a dynamically controlled suspension system for supporting the washer/extractor from a stationary frame to minimize forces exerted onto the frame and transmitted to the floor or other structure supporting the washer/extractor. The suspension system includes a plurality of supports extending between the frame and the washer/extractor at spaced apart locations in relation to the spin axis. At least one of the supports is a variable length member which may be continually adjusted to vary the distance between the frame and the washer/extractor and thereby minimize the forces caused by eccentric masses of textiles and washing fluids contained in the washer/extractor. A force sensor is provided for measuring the force acting between the washer/extractor and the frame. A processor is provided for receiving the measured force and generating an output response for varying the length of the support to minimize the value of the force and its vibratory effect on the frame. The suspension system is particularly useful for rotary washer/extractors having a drum rotating about horizontal as well as vertical axes and is especially adapted for reducing and minimizing vibratory forces.

15 Claims, 7 Drawing Sheets

FORCE MINIMIZING SUSPENSION SYSTEM FOR ROTARY WASHER/EXTRACTORS

This is a divisional application of application Ser. No. 07/762,379, filed Sep. 19, 1991 now U.S. Pat. No. 5,218,731.

BACKGROUND OF THE INVENTION

1. Field of the Invention

The present invention relates to a new and improved rotary type washer/extractor for textiles and other materials including a new and unique dynamic force minimizing, suspension system for supporting a rotating drum from a base or stationary structure of the machine. The new and improved dynamic suspension system of the present invention is also useful for devices other than rotary type washer/extractors in centrifugal machines of a wide variety wherein it is necessary and desirable to minimize loads or forces generated by a spinning mass which changes in terms of eccentricity, velocity and acceleration values during an operating cycle of the machine.

2. Background of the Prior Art

Rotary type centrifugal washing and extracting machines have been used in industrial and commercial laundry facilities and these machines generally employ large rotating drums for containing a mass of laundry material and washing liquid After washing is completed, the wash liquid is centrifuged out of the rotating drum at a relatively high speed at the end of a washing phase.

The following U.S. Patents disclose various prior art washing and extracting machines Adachi et al., U.S. Pat. No. 4,970,645; Broadbent, U.S. Pat. No. 4,916,768; Fesmire et al , U.S. Pat. No. 4,479,371; Fesmire et al., U.S. Pat. No. 4,467,530 and Toth, U.S. Pat. No. 3,945,921.

A common problem associated with all types of washer/extractors and other rotary centrifuge machines is the imbalance of material inside the machine This imbalance generates unbalanced forces that occur during a spin cycle. The magnitude of the unbalanced forces often becomes more acute during high speed extraction phases than during relatively lower speed washing phases. In large industrial and commercial machines, the unbalanced forces cause noise and vibrations which are transmitted to floor and other supports even though force dampening type suspension systems are provided. Excessive forces are sometimes carried through the base or frame structure of a spinning washer/extractor and impact upon a floor or other structure of the building in which a machine is housed.

Attention has been addressed to reducing the magnitude of unbalanced forces transmitted through the base of such machines to underlying building supporting structures The present invention is addressed towards a suspension system for such machines and designed for a minimization of such unbalanced forces so that a wider variety of locations for such machines are available with a minimum amount of floor structure or structural foundation base being required in the enclosed surrounding area.

U.S. Pat. No. 4,970,645 discloses a suspension control method and apparatus for a vehicle having each wheel of the vehicle independently supported on an air spring in conjunction with a controllable force damping shock absorber utilized for minimizing vibration and unbalanced forces. The disclosed suspension system provides a system for sampling the damper stroke position on the shock absorber at each wheel and generating a control signal to a central processing unit. The central processing unit sends an output signal to each wheel to adjust the air spring to provide a hard or soft ride and to adjust the shock absorber to provide a hard, middle or soft value of dampening.

SUMMARY OF THE INVENTION

It is an object of the present invention to provide a new and improved rotary type washer/extractor for textiles and other materials and more particularly to provide a new and improved suspension system for a washer/extractor of the type described which minimizes the value of unbalanced forces generated by the machine that must be supported from a building floor or other structure on which the washer/extractor is mounted.

Another object of the present invention is to provide a new and improved, dynamic suspension system for rotary centrifuge machines, which system is effective for reducing unbalanced forces transmitted from the base or frame of the machine to a supporting structure.

More particularly, it is an object of the present invention to provide a new and improved, dynamic, force minimizing suspension system for a rotary enclosure for containing a mass of material and/or fluids spinning about an axis and supported from a stationary base at a plurality of locations Still another object of the present invention is to provide a new and improved suspension system of the character described in the preceding object which has means for adjusting the length of individual supporting members in order to minimize the forces involved during a condition wherein a mass of material contained in a drum or casing of the machine becomes eccentric with respect to a spin axis.

Yet another object of the present invention is to provide a new and improved rotary centrifugal machine for handling a wide variety of materials which are treated by centrifugal action in an enclosing drum or casing; the machine being especially well adapted for handling large loads that may become eccentric or out of balance with respect to the rotating spin axis.

Another object of the present invention is to provide a new and improved rotary centrifugal machine which is economical in operation and capable of handling a wide variety of materials and fluids and a wide range of load sizes of material treated in a spinning or rotating drum or casing.

The foregoing objects and advantages of the present invention are accomplished in a new and improved rotary washer/extractor for textiles and other materials which includes a stationary base or frame providing support for a drum containing a mass of textiles and washing fluid. The drum is mounted to rotate about a spin axis relative to the base on a new and unique suspension system including a plurality of independent supports extending between the base and the drum at a plurality of spaced apart positions in relation to the spin axis. At least one of the supports is variable in length to alter the distance between the base and the drum in response to the amount of force that is sensed or measured between the drum and the base at a particular location. A processor receives a sensed signal and generates an output signal for controlling variable length support in order to minimize the value of any unbalanced force that will be transmitted between the support base of the washer/extractor and a supporting structure or building floor.

BRIEF DESCRIPTION OF THE DRAWINGS

For a better understanding of the present invention, reference should be had to the following detailed description taken in conjunction with the drawings, in which.

DETAILED DESCRIPTION OF PREFERRED EMBODIMENTS OF THE INVENTION

Figure 1:
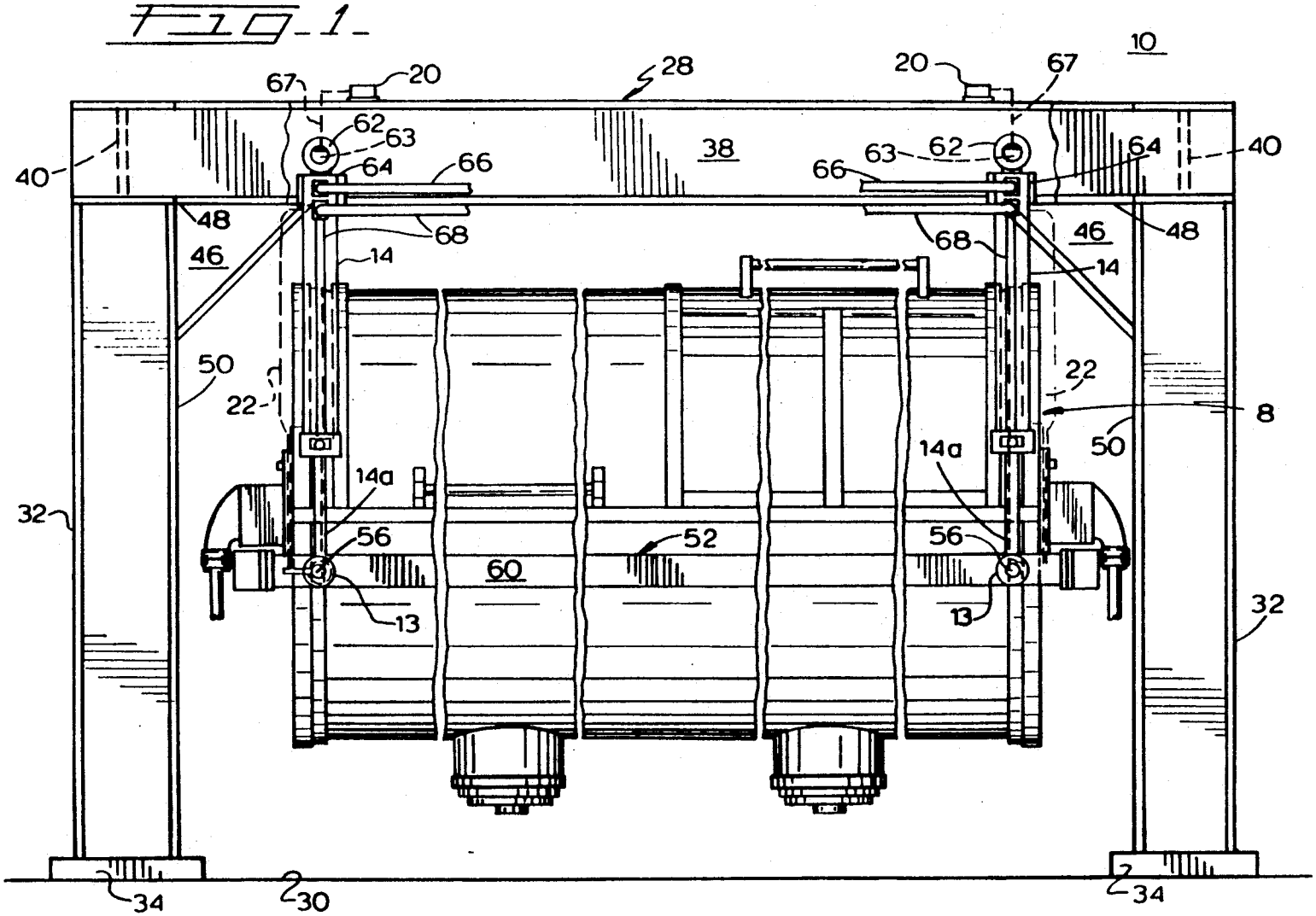
FIG. 1 is a front elevational view of one embodiment of a new and improved rotary washer/extractor for textiles and other materials constructed in accordance with the features of the present invention.
Figure 2:
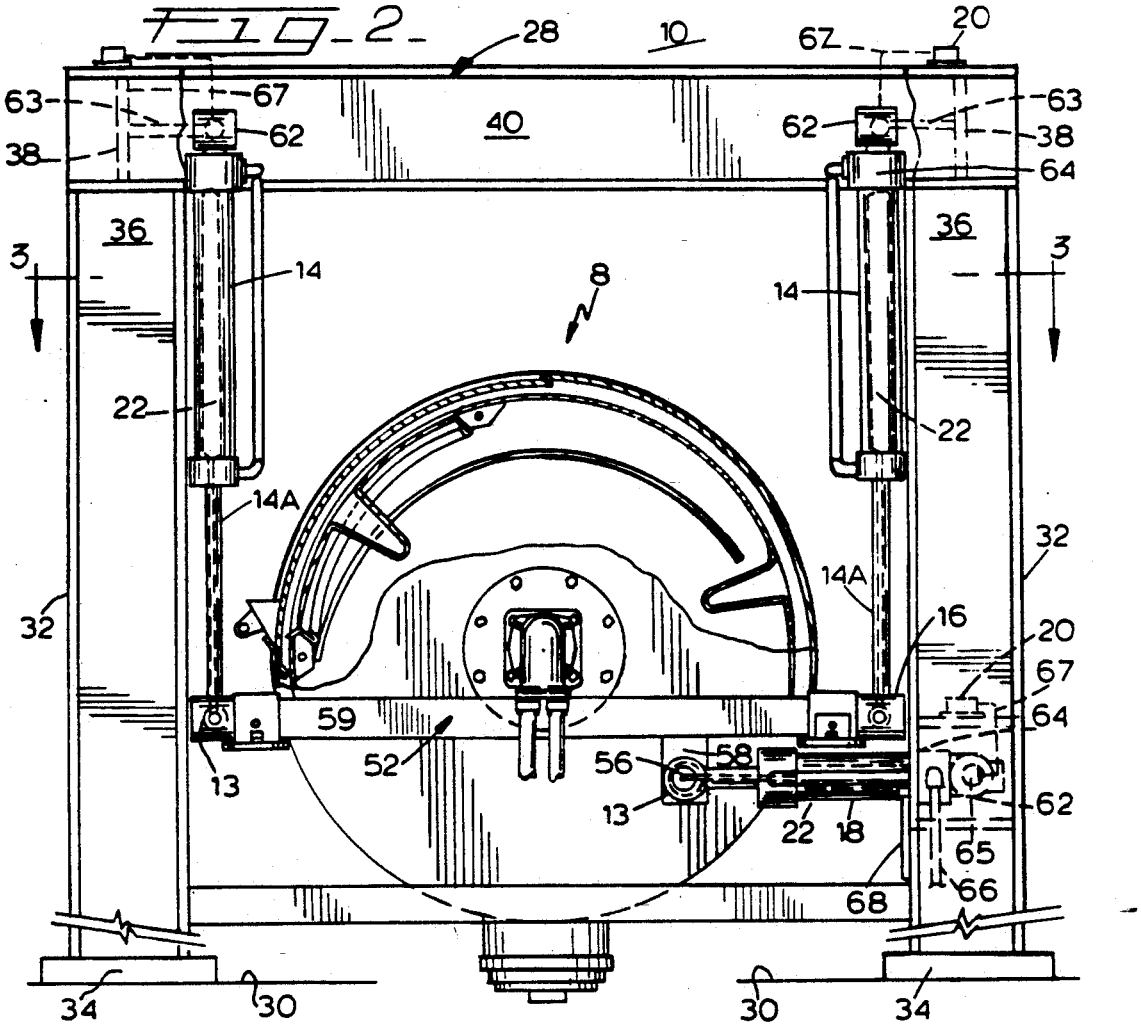
FIG. 2 is a transverse cross-sectional view taken substantially along lines 2—2 of FIG. 1.
Figure 3:
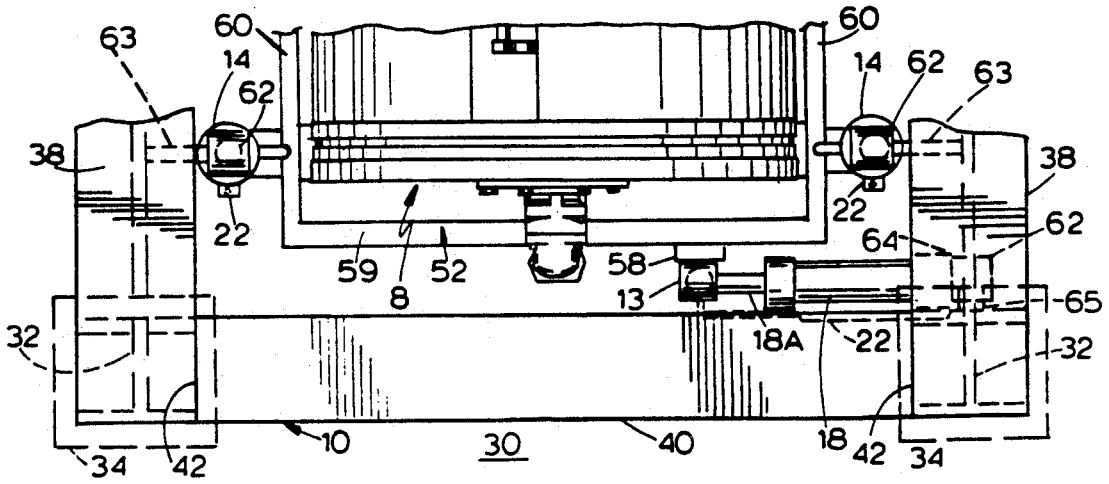
FIG. 3 is a horizontal cross-sectional view taken substantially along lines 3—3 of FIG. 2.

Referring now to the drawings, with particular attention to FIGS. 1, 2 and 3, a horizontal rotary washer/extractor 8 includes a suspension system generally designated by the reference numeral 10. While the washer/extractor 8 is depicted and generally described herein for use with the suspension system 10, the principles of the present invention are also applicable to other rotary machines.

As major components, the suspension system 10 includes a plurality of vertically extending hydraulic cylinders 14 that support the washer/extractor 8 and are arranged to reduce vertical unbalanced forces generated by the rotating washer/extractor 8. The suspension system 10 further includes a plurality of horizontally extending hydraulic cylinders 18 that stabilize the washer/extractor 8 and are arranged to reduce horizontal unbalanced forces generated by the rotating washer/extractor 8. A load cell 20 coupled to each hydraulic cylinder 14 and 18 measures the force developed at each cylinder 14 and 18. A linear velocity-displacement transducer (LVDT) 22 provided at each cylinder 14 and 18 measures the length and rate of change of the length of a piston rod 14*a* and 18*a* extending from the cylinders 14 and 18 to a ball joint assembly 13. A four-way hydraulic valve 24 controls the position of each hydraulic cylinder 14 and 18 (FIG. 6), in conjunction with computer 26 provided for controlling the overall operation of the suspension system 10.

A support frame generally designated by the reference character 28 is securely mounted on a concrete floor 30 or other supporting structure for providing a firm foundation for the extractor 8. The support frame 28 includes four vertically extending steel support posts 32 of equal length secured to the concrete floor 30 at a lower end by base plate 34, and configured such that when viewed from above (FIG. 3), upper ends 36 of the vertical post 32 form four corners of an elevated rectangular framework having a longitudinal dimension relatively longer than the longitudinal horizontal axis of the washer/extractor 8 and a lateral dimension relatively longer than the diameter of the washer/extractor 8. A longitudinal horizontally extending support beam 38 is secured to the upper ends 36 of each pair of front and rear vertical posts 32 thereby forming an upper longitudinal side of the support frame 28. A laterally extending horizontal support beam 40 is secured to the opposite ends of each pair of longitudinal beams 38 forming the lateral sides of the support frame 28 Opposing ends 42 of the lateral support beams 40 are secured perpendicular to respective inner sides of the longitudinal support beams 38 (FIG. 3). Angle support bars or gussets 46 are integrally secured to a lower side 48 of each longitudinal support beam 38 and an adjacent first side 50 of each of the four vertical support posts 32 such that when taking a longitudinal side view of the support frame 28 as shown in FIG. 1, the support posts 32, longitudinal beams 38 and gussets 42 form sets of isosceles right triangles.

A rectangularly-shaped, horizontally extending casing support bracket 52 surrounds and is secured to a lower portion of the washer/extractor 8. The surrounding bracket 52 is supported from a plurality of ball joint assemblies 13 which are interconnected between cross pins 56 at the outer ends of the piston rods 14*a* and 18*a* of the vertical and horizontal hydraulic cylinders 14 and 18 and the frame members 59 and 60 of the bracket 52. The ball joint assemblies 13 on the horizontal cylinders 18 are attached to depending brackets 58 on opposite side members 59 of the support bracket 52, and the ball joint assemblies 13 on the vertical cylinders 14 are secured directly to longitudinal frame elements 60 of the rectangular support bracket 52.

A ball joint type cylinder support assembly 62 is provided at a base or closed end 64 of each horizontal and vertical hydraulic cylinder 14 and 18. The cylinder supports 62 on the vertical cylinders 14 are mounted at the upper end and are secured to respective longitudinally extending horizontal support beams 38 on support pins 63. The cylinder supports 62 on the horizontal cylinders 18 are secured to respective rear side vertical posts 32 on support pins 65.

The vertical and horizontal hydraulic cylinders 14 and 18 are similar in structure and function to the cylinders disclosed in SU authorship certificates No. 1338475 and 1318756 by A. A. Simon of Leningrad in the Soviet Union. Each cylinder is supplied with hydraulic fluid from opposite ends via first and second hydraulic fluid lines 66 and 68 connected to a four-way hydraulic valve 24. The four-way valves 24 are all similar in structure and function and are electronically controlled to extend or withdraw the respective cylinder rods 14*a* and 18*a* in response to signals received from the computer 26. Pressurized hydraulic fluid required to operate the cylinders 14 and 18 is supplied to input ports of the respective four-way valves 24 by a pressure line 70 (FIG. 6) which receives hydraulic fluid from a pump 72. A return line 74 directs the hydraulic fluid from exhaust ports of the four-way valves 24 back to a reservoir 76. A pump supply line 78 connects the reservoir 76 to the pump 72 thereby completing a hydraulic fluid loop.

Figure 4:
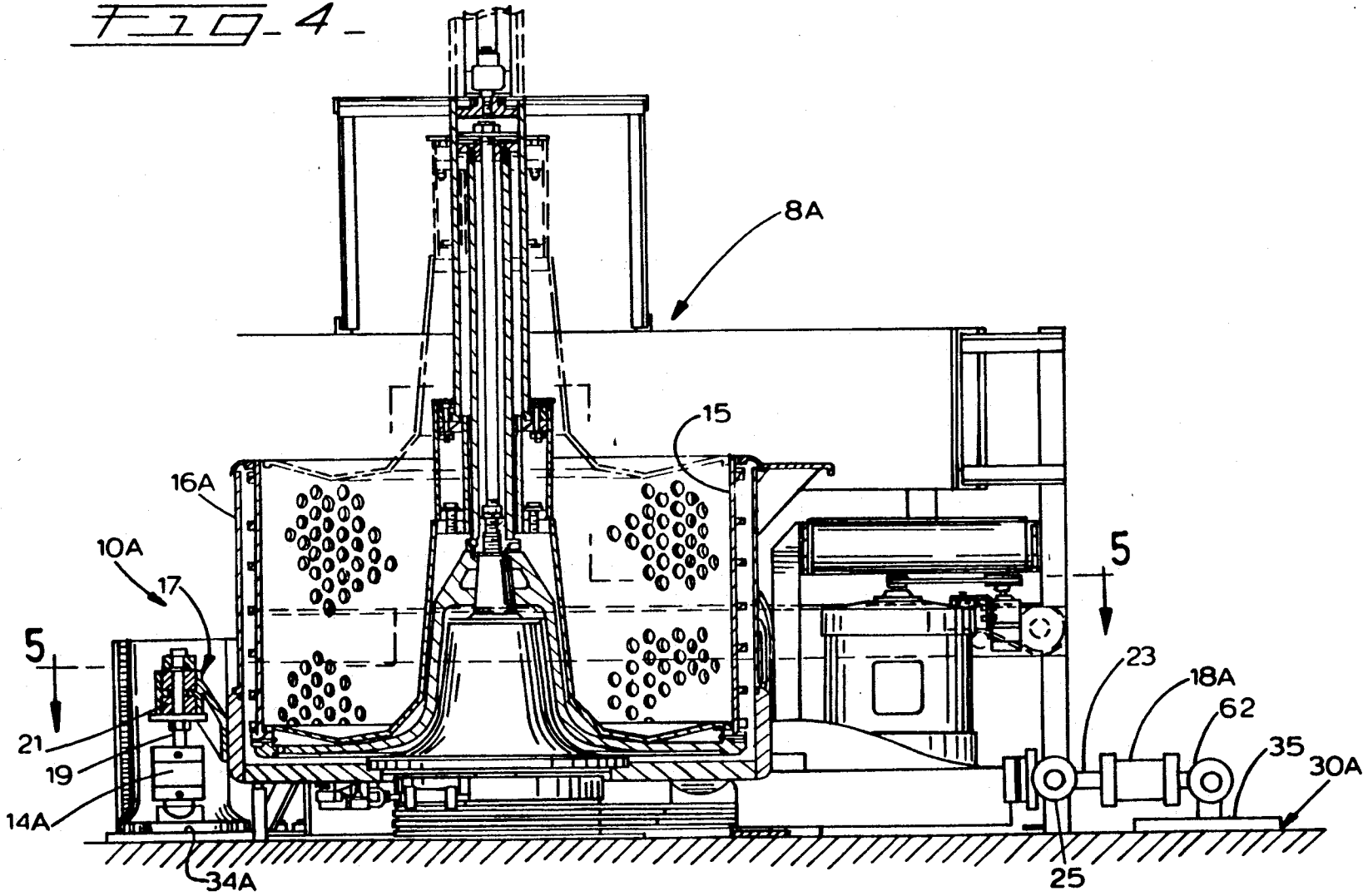
FIG. 4 is a vertical cross-sectional view of another embodiment of a new and improved rotary washer/extractor machine in accordance with the present invention of a type having a drum or enclosure rotatable about a vertical spin axis.
Figure 5:
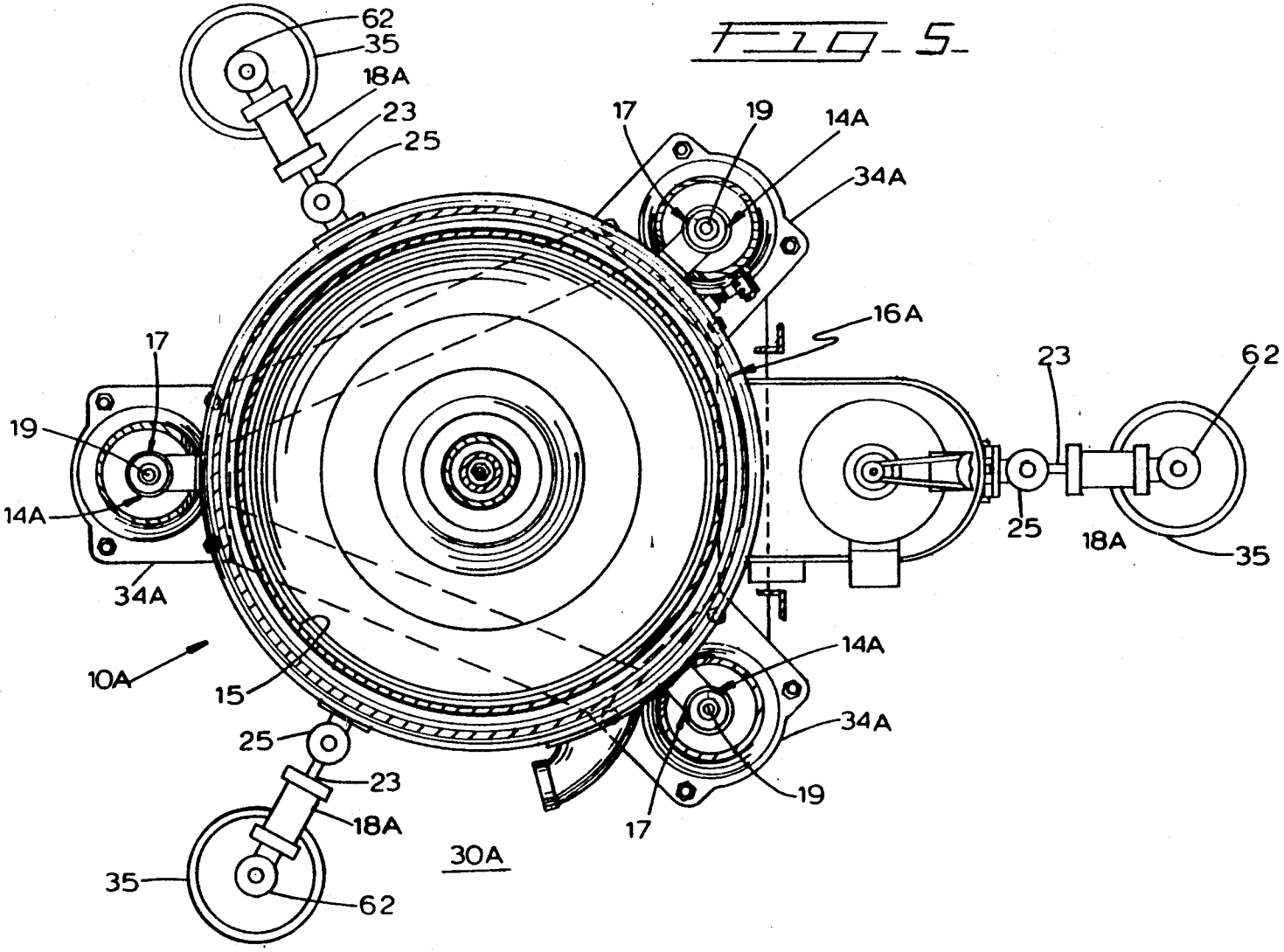
FIG. 5 is a horizontal cross-sectional view taken substantially along lines 5—5 of FIG. 4.

Referring to FIGS. 4 and 5, elevation and plan views are illustrated for a rotary washer/extractor 8A and suspension system 10A having a cylindrical casing 16A with a vertical longitudinal axis supported by three equilaterally spaced vertically extending hydraulic cylinders 14A. Three horizontally extending hydraulic cylinders 18A are provided to stabilize and minimize side loading imposed by the operation of the washer/extractor 8A on mounting bases 34A supported on a concrete floor 30A or other supporting structure. The washer/extractor 8A is of a type disclosed in U.S. Pat. No. 3,945,921, which is incorporated herein by reference. One should refer to this patent for an understanding of the operation and structural components of the washer-/extractor 8A.

The cylindrical casing 16A is designed to contain a quantity of washing liquid and goods such as textiles in a rotatable perforated cage 15 mounted for rotation about a vertical axis coincident with the central axis of the casing 16A.

The casing 16A includes three equilaterally spaced, outwardly extending radial support arms 17 supported at the upper ends of respective piston rods 19 of the hydraulic cylinder 14A and connected thereto by shock absorbent connector assemblies 17. The lower end of each cylinder 14A is supported on a ball joint assembly 62 mounted on a pad 34A and provided with a load sensing cell 20 as in the prior embodiment. In addition, LVDT's 22 are provided for each cylinder 14A as in the prior embodiment.

Lateral load stability is controlled by the three equilaterally spaced apart, radially extending horizontal cylinders 18A, each having a piston rod 23 interconnected at an outer end via a shock absorbing connector assembly 25 connected to a side wall of the casing 16A. The outer end or base of each horizontal cylinder 18A is provided with a ball joint type support assembly 62 containing a load sensing cell 20 as in the prior embodiment. The ball joint assemblies 62 are in turn mounted on circular support pads 35 secured to the floor 30A or other support structure. Each horizontal cylinder 18A is provided with a LVDT 22 as in the prior embodiment.

Figure 6:
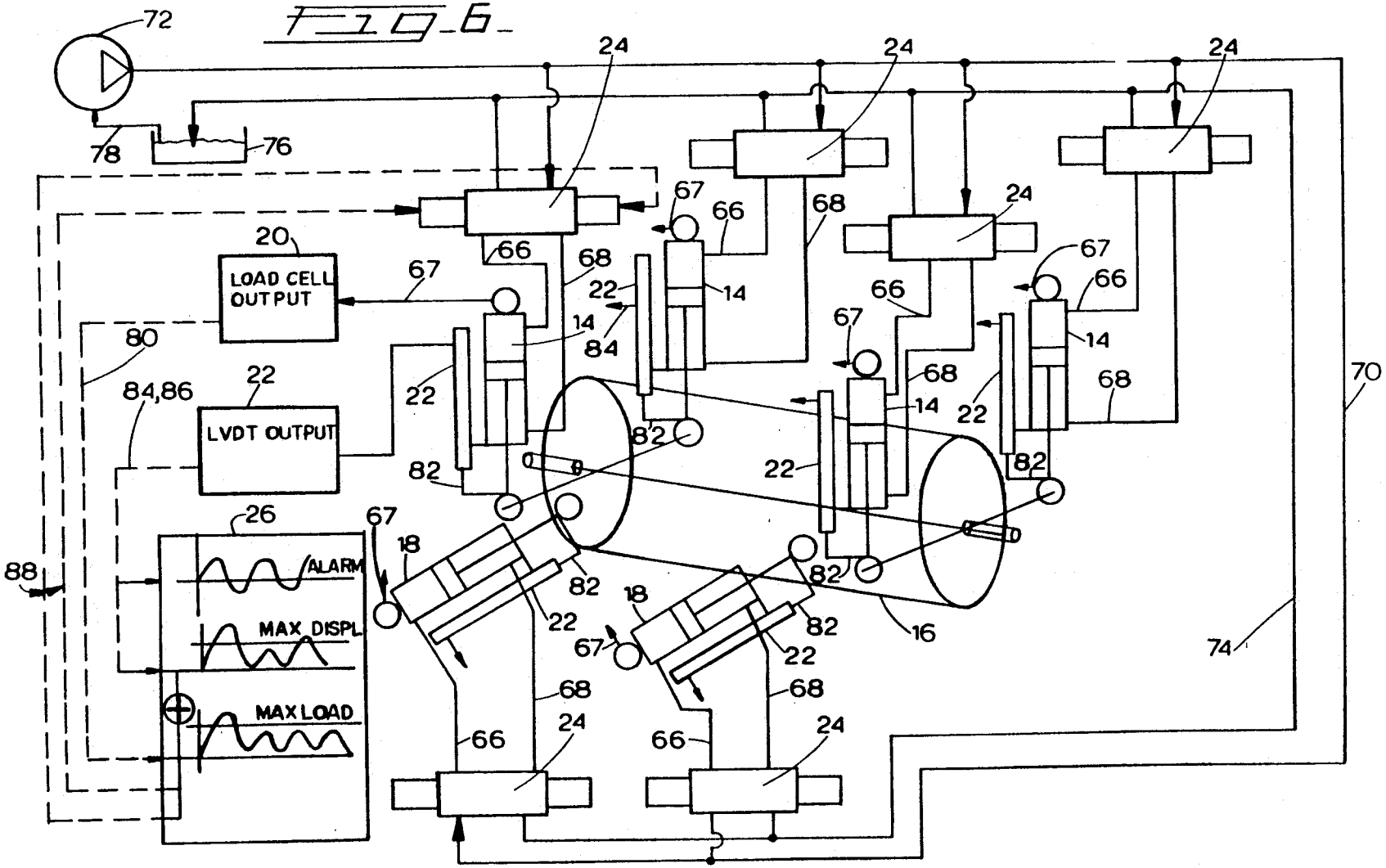
FIG. 6 is an electrohydraulic diagram of a new and improved control system for a suspension system utilized in the washer/extractor of the present invention.
Figure 7:
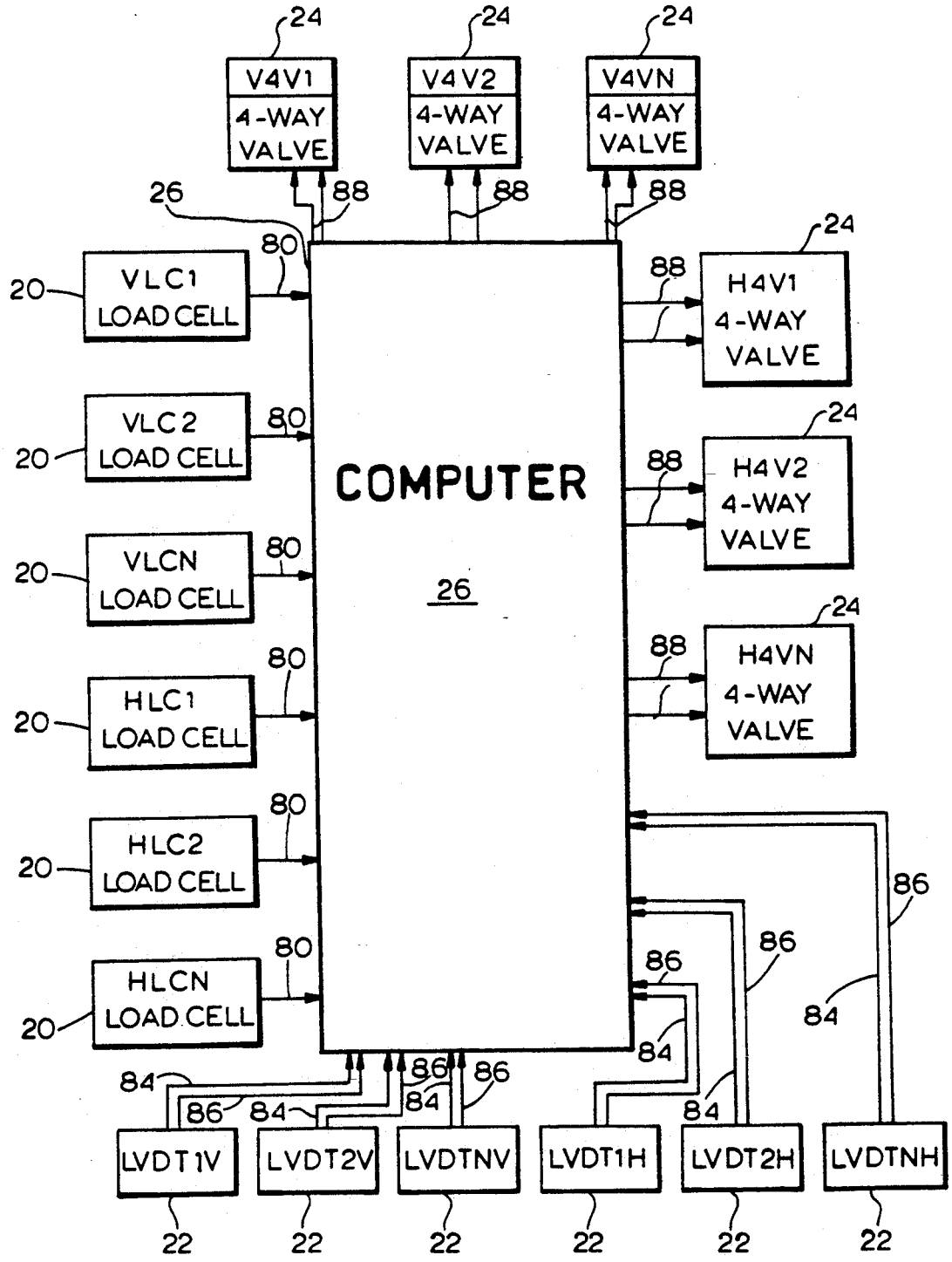
FIG. 7 is a block diagram of the overall washer/extractor suspension control system of the present invention.
Figure 8:
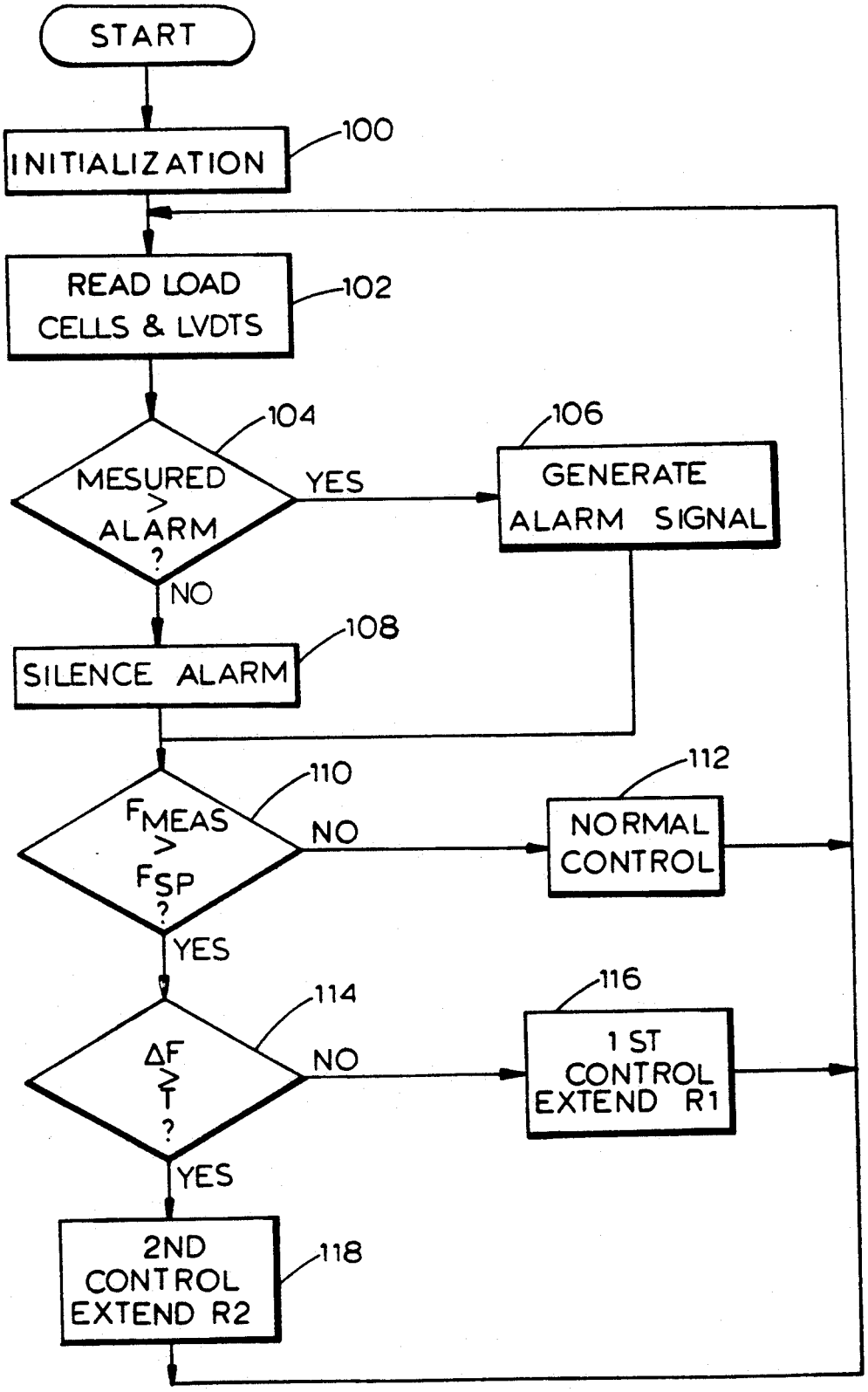
FIG. 8 is a flow chart illustrating the control operation of the washer/extractor suspension control system of FIG. 7.

The vertically orientated washer/extractor 8A utilizes the same components and has the same control scheme as utilized for the horizontally orientated washer/extractor 8 and the diagrams of FIGS. 6, 7 and 8 are applicable to the washer/extractor 8A.

Referring to FIG. 6, a partly schematic and block diagram representation illustrating the horizontal rotary washer/extractor 8 and suspension system 10 is shown.

Load cells 20 are connected to the ball joint support assemblies 62 of each cylinder 14 and 18 via electrical leads 67 for measuring the force exerted on each cylinder when the washer/extractor 8 is operating. Each load cell 20 is provided with an output lead 80 for directing a signal corresponding to the force as measured on each hydraulic cylinder 14 and 18 as an input to the computer 26.

Linear displacement transducers of the type manufactured and sold by Data Instruments Inc., 100 Discovery Way, Action, Mass. 01720 can be used for LVDT 22. One LVDT 22 is mounted on each hydraulic cylinder 14 and 18 such that there is no physical contact between the transducer 22 and the piston rods 14*a* and 18*a* thereby providing rod extension and velocity measurements without interfering with the operation of the cylinders 14 and 18. Each transducer 22 is provided with a first output lead 84 for directing a signal corresponding to the length of piston rod protruding from each hydraulic cylinder 14 and 18, and a second output lead 86 for providing a signal corresponding to the velocity of the piston rods 14*a* and 18*a* moving along their own respective longitudinal axes. The first and second outputs 84 and 86 of all of the respective LVDT's 22 are applied to the computer 26.

In operation, as the RPM of the washer/extractor 8 increases, out of balance forces are detected by the load cells 20. Computer 26 reads the force measurements from the load cells 20 and velocity-displacement measurements from the LVDT's 22. Then computer 26 generates output signals 88 based upon the force and velocity-displacement measurements to respective four-way valves 24 that position respective hydraulic cylinders 14 and 18 in direct response to the output signals 88.

Referring to the block diagram in FIG. 7, computer 26 utilizes the output signals from lines 80, 84 and 86 from the respective load cells 20 and LVDT's 22 to provide two independent corresponding output signals sent via lines 88 to each four-way hydraulic valve 24.

Operation of the suspension system 10 is illustrated in the flow charts of FIG. 8. Referring to FIG. 8, the sequential operations performed by the computer 26 during a force minimization procedure begin with initialization as indicated at a block 100. Computer 26 reads signals 80, 84 and 86 from the load cells 20 and the LVDT's 22. The signals are compared to an alarm threshold value as indicated at a decision block 104. When any signal is above an alarm point, computer 26 initiates an alarm as indicated. A generated alarm remains active until the alarm condition clears as indicated at a block 108. The measured forces $F_{MEAS}$ are compared to a threshold value or force set point $F_{SP}$ as indicated at a decision block 110. When measured forces are below the threshold value $F_{SP}$, computer 26 returns the corresponding hydraulic cylinders to their normal positions indicated at block 112. When any load cell signal 80 corresponding to a measured force $F_{MEAS}$ is above the set point $F_{SP}$, a calculated rate of change of the measured forces $\Delta F$ hydraulic cylinder is compared with a threshold value T as indicated at a decision block 114. When the rate of change $\Delta F$ is less than or equal to the threshold value T, a first responsive control signal R1 is generated for extending the hydraulic cylinder at a first extend rate R1 as indicated at a block 116. Otherwise, when the rate of change is greater than the threshold value T, a second responsive control signal R2 is generated as indicated at a block 118 for extending the hydraulic cylinder at a second extend rate R2. Sequential monitoring and control operation continue returning to block 102.

Utilizing the aforementioned method of suspension for a washer/extractor 8 instead of the usual arrangement of high mass springs, air bags and/or shock absorbers, enables the washer/extractor to absorb higher forces from out of balance wash loads and reduce the need to shut down the system in the middle of a cycle and reset it. Because the machine movement is being measured and controlled, it is now possible to reduce the amount of shaking common to this type of equipment. Stresses caused by vibration will also be significantly reduced.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A rotary centrifugal machine comprising
stationary base means;
an enclosure for containing a mass of material rotatable about a spin axis relative to said base means;
support means for controllably supporting said enclosure from said base means relative to said spin axis, said support means having a selectively controlled variable length extension between said base means and said enclosure;
sensor means for measuring the force acting between said support means and said stationary base means for generating a signal responsive to the magnitude of said force; and
means for processing said signal from said sensor means for generating an output response acting on said support to vary the length thereof for minimizing the force acting between said support means and said base means.

2. A rotary centrifugal machine as recited in claim 1 wherein said sensor means further includes means for measuring the length of said selectively controlled variable length extension of said support means.

3. A rotary centrifugal machine as recited in claim 2 wherein said sensor means further includes means for measuring the rate of change of the length of said selectively controlled variable length extension of said support means.

4. A rotary centrifugal machine as recited in claim 2 wherein said sensor means includes at least one linear velocity displacement transducer.

5. A rotary centrifugal machine as recited in claim 1 wherein said support means includes at least one double acting hydraulic cylinder.

6. A rotary centrifugal machine as recited in claim I wherein said support means includes at least one electrically controlled 4-way hydraulic valve.

7. A rotary centrifugal machine as recited in claim 1 wherein said sensor means includes at least one load cell.

8. A rotary centrifugal machine as recited in claim 1 wherein said processing means includes means for determining if any force measurements are above an alarm setting.

9. A rotary centrifugal machine as recited in claim 1 wherein said processing means includes means for determining if any force measurements are above a first set point.

10. A rotary centrifugal machine as recited in claim 1 wherein said processing means includes means for determining the rate of extension of said support means.

11. A dynamically controlled, forceminimizing, suspension system for an enclosure for containing a mass of material for rotation about a spin axis and supported from a stationary base by support members at a plurality of locations; said suspension system comprising:
means for sensing the force acting between one of said support members and said enclosure and said base;
means for generating an output signal in response to the force as sensed; and
means for varying the length of said support member in response to said output signal to minimize said force.

12. A suspension system as recited in claim 11 wherein said sensing means includes at least one load cell.

13. A suspension system as recited in claim 11 wherein said signal generating means includes a microcomputer.

14. A suspension system as recited in claim 11 wherein said support length varying means includes at least one electrically controlled four-way hydraulic valve.

15. A suspension system as recited in claim 11 wherein said support members include at least one double acting hydraulic cylinder.

* * * * *